United States Patent [19]

Salomon

[11] 4,266,801

[45] May 12, 1981

[54] BRAKING DEVICE FOR SKIS

[75] Inventor: Georges P. J. Salomon, Annecy, France

[73] Assignee: Etablissements Francois Salomon et Fils, Annecy, France

[21] Appl. No.: 957,271

[22] Filed: Nov. 3, 1978

[30] Foreign Application Priority Data

Nov. 4, 1977 [FR] France ..... 77 33250

[51] Int. Cl.[3] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,989,271 | 11/1976 | Riedel | 280/605 |
| 4,078,825 | 3/1978 | Riedel | 280/605 |
| 4,087,113 | 5/1978 | Riedel | 280/605 |
| 4,123,083 | 10/1978 | Riedel | 280/605 |
| 4,124,223 | 11/1978 | Kubelka | 280/605 |
| 4,127,284 | 11/1978 | Schweizer et al. | 280/605 |
| 4,138,137 | 2/1979 | Beyl | 280/605 |

FOREIGN PATENT DOCUMENTS

| | | | |
|---|---|---|---|
| 2412623 | 11/1975 | Fed. Rep. of Germany | 280/605 |

*Primary Examiner*—David M. Mitchell

*Attorney, Agent, or Firm*—Pollock, Vande Sande & Priddy

[57] ABSTRACT

The present invention relates to a ski brake, including a braking member having two free ends connected by a yoke having two rectilinear portions mounted to pivot on a base plate. A resilient member connected by a pedal to the yoke urges the braking member into a raised position. Small movable connecting rods placed between the yoke and the base plate cause the free ends to return. The device significantly reduces the effects on the ski boot of keeping the braking member in depressed position.

7 Claims, 5 Drawing Figures

BRAKING DEVICE FOR SKIS

BACKGROUND OF THE INVENTION

The present invention relates to braking devices for skis, more particularly those in which the passage of the braking members from their operative braking position to their inoperative skiing position is effected by vertical and lateral retraction.

At the present time, safety straps have largely been abandoned in favor of ski brakes. These braking devices generally comprise at least one braking member (and preferably two) which, at the moment the binding is released, swings under the influence of a resilient means jutting out from the lower surface of the ski, and stops the ski close to the skier. When the ski is put on again, the action of the boot on a pedal causes the braking member or members to go up so as to permit skiing to proceed. This motion is generally made by rotation about an axis which extends substantially transversely of the longitudinal axis of the ski.

With this known arrangement, there is only one vertical retraction of the braking member or members which, though they do not jut out from the bottom of the sliding surface, nevertheless pass laterally beyond the ski edges. This lateral extension is detrimental, because during certain movements, there is the danger that the braking member or members may bite prematurely into the snow or even into roots or stones. To overcome this disadvantage, it has already been suggested to provide for lateral as well as vertical retraction when the ski is put on, so that the braking member(s) during skiing are also retracted in relation to the edge of the ski, to allow trouble-free edging movements.

SUMMARY OF THE INVENTION

The present invention is concerned with braking devices of the second type mentioned hereinabove, which comprise at least one braking member flexibly secured to the ski and movable between an operative braking position in which it juts out from the lower plane of the ski and an inoperative skiing position, said braking member being joined to a control device which is sensitive to the presence of the boot to assure its passage from the operative to the inoperative position when the ski is put on, by a substantially vertical swing of the braking device until it reaches a level above the upper plane of the ski, combined with a lateral movement in the direction of the longitudinal axis of the ski.

According to one aspect of the invention, said device is characterized in that at least one movable small connecting rod connects a portion integral with the braking member to a fixed point of support integral with the ski, keeping the area of said member in contact with the connecting rod at a constant distance from the point of support, so that displacement of the connecting rod brings about a variation in the spacing between the braking member and the plane passing through the longitudinal axis of the ski and perpendicular to the surface of the latter.

According to a more special aspect of the invention, the use of a device with a connecting rod such as described above prevents, under certain conditions, the braking device from interfering with the boot while in its inoperative position.

As a matter of fact, in the prior art devices, the lateral retraction, which necessarily proceeds against the action of a resilient force, creates additional strains on the boot in the put-on position, particularly vertical loads, which may be detrimental because, on the one hand, they oppose the retaining force applied to the boot by the heel wing and, on the other hand, they induce rubbings on the sole of the boot which may disturb the safety of the lateral release.

This is due to the fact that the passage of the braking member or members from the operative to the inoperative position is brought about by a vertical swing of the braking device against a force having at least one vertical resilient retraction component and by lateral retraction of the braking device against a lateral resilient retraction movement; the vertical swing may be effected in a plane extending either vertically or obliquely to the ski.

The braking device according to the invention can assure lateral retraction of the braking members, thereby eliminating or reducing the above-mentioned disadvantages arising from this lateral retraction by use of a simple device which does not cause additional extraneous (especially vertical) loads on the level of the boot when the binding is fastened.

To accomplish this, the device according to the invention has means for assuring, once the braking member or members are in their laterally retracted position, the neutralization of any vertical components, caused by the lateral elastic pullback force, which can be applied to the boot.

In the event the braking member is joined to an element which is slidably mounted in relation to the ski and is sensitive to the presence of the boot, the lateral retraction being brought about by displacement of the movable element against the action of a resilient force to which it is subjected, the means assuring the neutralization of the vertical component will be constituted by a structure and, more particularly, by the movable connecting rod indicated above, which coacts with the movable element and which, in the retracted position of the braking member, acts on the movable element in the plane of the ski in a direction converging toward the longitudinal axis of the latter. Preferably, the direction of the action is perpendicular to the axis of the ski.

The movable connecting rod permits, by sliding, its relative motion vis-a-vis the movable element. According to one preferred embodiment, the connecting rod is mounted to pivot about a geometrical axis of rotation which is fixed in relation to the ski and is perpendicular to its upper plane.

BRIEF INTRODUCTION TO THE DRAWINGS

In order that the invention may be more clearly understood, reference will now be made to the accompanying drawings, wherein an embodiment of the invention is shown for purposes of illustration, and wherein.

DESCRIPTION OF PREFERRED EMBODIMENT

Figure 1:
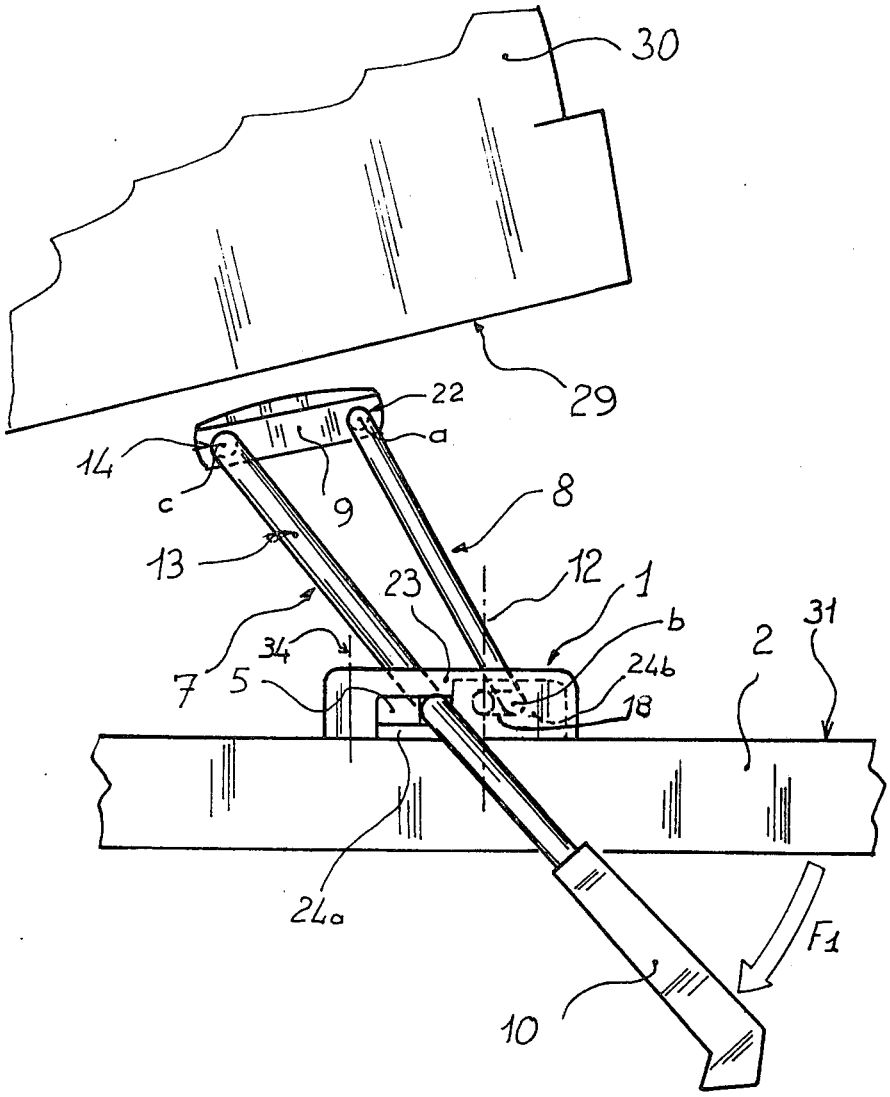
FIG. 1 is a side view showing the brake according to the invention in its operative braking position.

In the accompanying drawings, there is attached to ski 2 by means of screws 12 a base plate 1 by which the braking device comprises a braking member 7, resilient member 8 (or brake-actuating stirrup) and support pedal 9 which couples resilient member 8 to braking member 7, said pedal forming the portion of the brake which is sensitive to the presence of boot 30.

Figure 4:
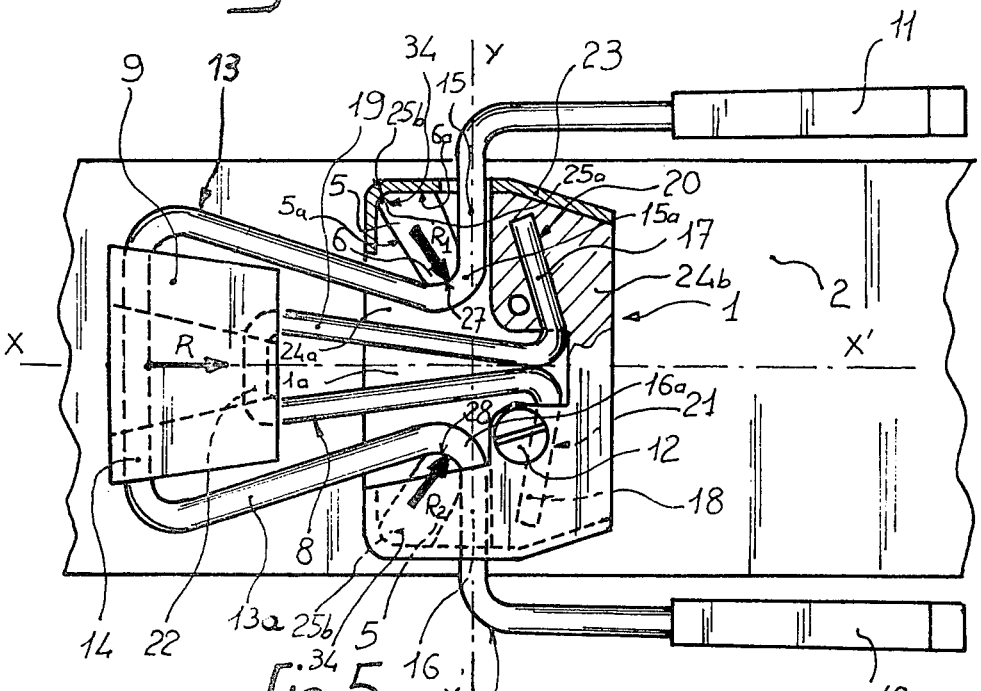
FIG. 4 is a top view of FIG. 2, the upper part of the base plate being partially broken away.
Figure 5:
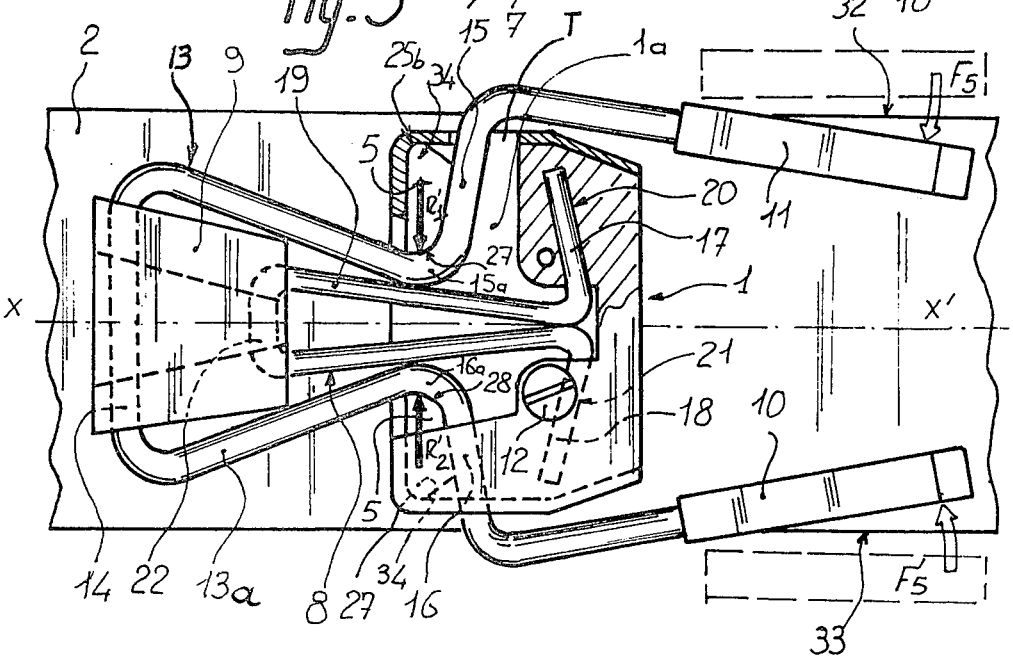
FIG. 5 is a top view of FIG. 3, the upper part of the base plate being partially broken away.

In the example shown, the braking member is formed by a cylindrical steel wire substantially bent in the shape of a U, whose free ends 10 and 11 form two braking members interconnected by a yoke 13 having substantially the form of a Ω (FIGS. 4 and 5). The yoke is integral with two rectilinear portions 15 and 16 which are inserted in housing 1*a* of base plate 1 and traverse elongated holes T (FIG. 5) drilled in the side walls of the base plate, such that they are free for both rotary and linear movement. Rectilinear portions 15 and 16 serving as an axis of rotation for the braking member are bent at right angles to braking members 10 and 11 and are prolonged by way of elbows 15*a*, 16*a* into slightly divergent arms connected by median leg 14. It will be noted that the braking member is preferably symmetrical (as shown) in relation to the longitudinal axis X—X' of the ski.

Resilient brake-actuating member 8 also has a configuration substantially in the form of a Ω and consists of a cylindrical steel wire whose free ends 17 and 18, slightly converging toward the longitudinal axis of the ski, are rotatably engaged in cylindrical passageways or bearings 20 and 21 in base plate 1. Ends 17 and 18 are joined by a buckle 19. It will be noted that, in rest position, ends 17 and 18 do not lie in the same plane as buckle 19 (FIG. 1), with the result that since ends 17 and 18 are held in position on the ski by bearings 20 and 21, buckle 19 will have a natural tendency to be held resiliently in the raised positon shown in FIG. 1. Any action on buckle 19 will cause an elastic deformation of the resilient member, and the stored energy will bring buckle 19 automatically to its initial position when the depressing force thereon ceases.

Cross portion 22 of buckle 19 is parallel to median leg 14 of the braking member and brake-actuating pedal 9 connects them, allowing relative rotary motion between the pedal and members 14 and 22.

Preferably, as shown especially in FIGS. 4 and 5, the base plate comprises metal frame 23, which forms a hood and covers a plastic member having a thin portion 24*a* and a thicker portion 24*b*. Portion 24*a* lies against the ski and leaves a free space 1*a* between it and frame 23 for the reception and displacement of portions 15 and 16.

It will be noted that bearings 20 and 21 are formed in the thick portion 24*b* and that orifices T have been drilled in the sides of body 23. Said bearings 20 and 21 converge toward ski axis X—X' and lie in a plane substantially parallel to the plane of the ski. Two movable connecting rods 5 substantially parallel to the ski plane are located in inner space 1*a* of the base plate. Said connecting rods 5 each lie between the metal wall of frame 23 and a portion of braking member 7.

In the example shown, each connecting rod has a rounded off end 6 placed in the inner portion 27, 28 of elbow 15*a*, 16*a* of braking member 7, while the other end is chamfered at 6*a*, said chamfered edge 6*a* being joined to lateral edge 5*a* of the connecting rod by a rounded off portion 25*a* which fits into the corresponding rounded portion 25*b* of the metal body. It will be noted, as shown in FIGS. 4 and 5, that the connecting rods are thus capable of swinging in the base plate around center of rotation 34 (real or imaginary).

The operation of the device according to the invention will now be described in detail:

FIG. 1 shows the brake in its operative braking position, with actuating stirrup 8 tending to urge braking member 7 in the direction of arrow $F_1$. Pedal 9 assures the connection between members 7 and 8.

Figure 2:
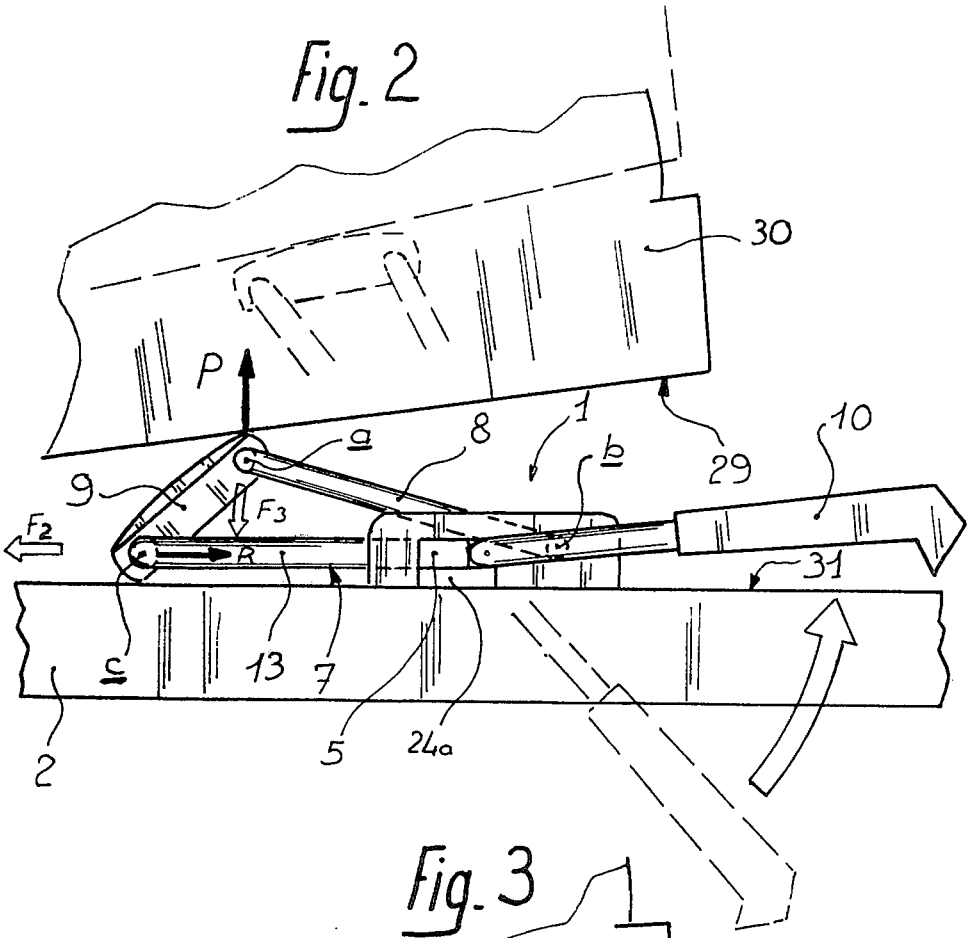
FIG. 2 is a side view showing the brake after vertical retraction of the braking members, i.e., in an intermediate position.

When the boot is put on, the action of lower surface 29 of boot 30 on pedal 9 will first cause the brake to go from the position shown in FIG. 1 to the intermediate position shown in FIGS. 2 and 4. Braking members 10, 11 will then be placed above the upper surface 31 of ski 2. This is the first phase of the motion, i.e., the vertical retraction phase with respect to the sliding surface of the ski. This motion is effected by rotation about axis YY' which passes through portions 15 and 16 (FIG. 4). The second phase is the lateral retraction phase of braking elements 10, 11 which are moved toward the interior of the ski so as no longer to extend beyond edges 32 and 33 of the ski (FIG. 5).

Figure 3:
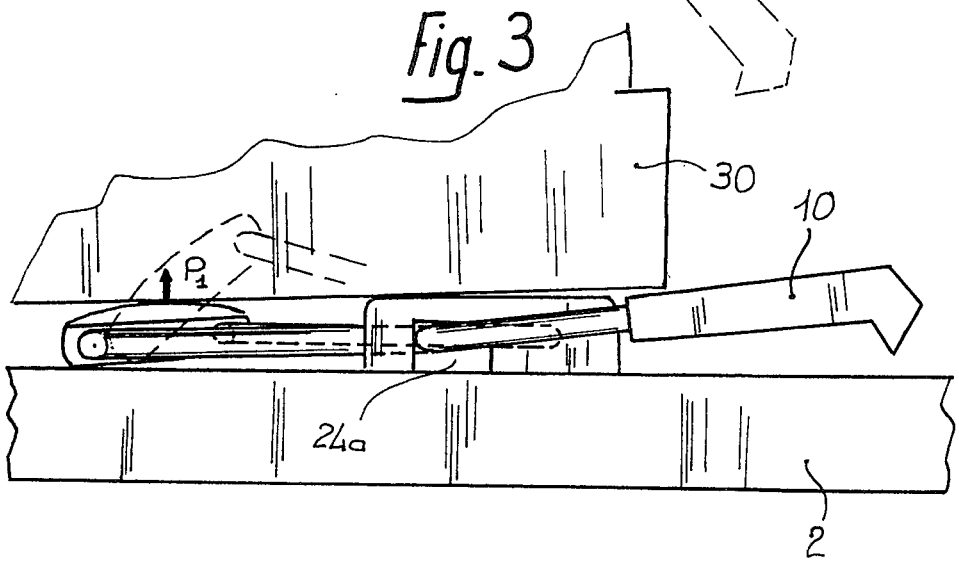
FIG. 3 is a side view showing the brake after lateral retraction of the braking members, i.e., in its inoperative skiing position.

Said second phase is likewise realized by the action of the boot on the pedal and one goes from the position shown in FIGS. 2 and 4 to the position shown in FIGS. 3 and 5.

In FIG. 2, the three points a (axis of articulation of pedal 9 on stirrup 8), b (pivoting axis of actuating stirrup 8) and c (axis of articulation of pedal 9 braking member 7) form a triangle. Point b alone is fixed and the action of the boot on the pedal will cause point a to move in the direction of arrow $F_3$, that is to say, following an arc of a circle centered on b, and point c in the direction of arrow $F_2$, i.e., in rectilinear direction substantially in the plane of the ski. Thus, braking member 7 is forced to move in the direction of arrow $F_2$. It is during this operation that retraction connecting rods 5 (FIG. 5) will be forced to make a rotary motion, i.e., about their centers of rotation 34.

The effect will be that elbows 15*a*, 16*a* will approach each other, median leg 14 having a fixed length; thus, the mutual approach of braking members 10 and 11 will be facilitated and there will be a lateral retraction of the free ends in the direction of arrows $F_5$ and $F_5'$ (FIG. 5).

The effect of the device according to the invention will now be shown with reference to an analysis of the stresses applied to the boot by the braking system in retracted position.

The action of the braking system on the boot occurs at the level of pedal 9. Assume that this action is a force P. This force P is the resultant of (a) the action of stirrup 8 which tends to rise (call this action $P_1$; and (b) the vertical action of braking member 7 on pedal 9 when the braking members are retracted laterally (call this vertical action $P_2$, where $P_2$ is a function of the force R applied to the pedal by the braking member).

The device according to the invention allows the reduction of said force P by virtually nullifying the influence of the lateral retraction of the braking members; in other words, a value substantially equal to zero is obtained for $P_2$.

In the intermediate position illustrated in FIGS. 2 and 4, connecting rods 5 are convergent and their action on braking members is $R_1$ and $R_2$, respectively. Thus, the total action of the braking members on the pedal is $R=R_1+R_2$. In the attached position shown in FIGS. 3 and 5, connecting rods 5 are perpendicular to longitudinal axis XX' of the ski and their action $R'_1$ and $R'_2$ on braking member 7 is oriented perpendicularly to XX'. Since these actions are identical and in opposite directions, braking member 7 does not act in the longitudinal direction on the pedal (R=0). Hence, $P_2$, which is a function of R, thus also equals zero. The lateral retraction thus does not produce a vertical action on the sole of the boot when the latter is in attached position.

In the described embodiment stirrup 8 is an actuating stirrup whose structure generates the resilient pullback force, but said stirrup could also have the form of a simple kinematic connecting rod, in which case braking member 7 would either have a structure assuring the generation of its own energy, or be urged into operative position by a spring, e.g., a torsion spring.

The movement in the direction of arrow $F_2$ (FIG. 2) is produced by means of the device equipped with a toggle consisting of stirrup 8 and pedal 9, but this could be modified by eliminating stirrup 8 and forcing the pedal in rectilinear direction through the interaction of ramps, one of which would be on the pedal and the other on a fixed member.

In the preferred embodiment shown, the movement of the connecting rods occurs in a plane which is substantially parallel to the ski, but this could be modified. In fact, it would be possible to construct a brake the reentry of whose braking member would be accomplished by a connecting rod articulated on a geometrical axis which is substantially parallel to the longitudinal axis of the ski, so that said connecting rod moves in a plane which is transverse and substantially perpendicular to the ski.

What is claimed is:

1. A braking device for skis comprising at least one braking member comprising a braking portion and an upper leg portion articulated on the ski for rotation about both a transverse, horizontal axis and a vertical axis at a location between said braking portion and said upper leg portion and movable between an operative braking position in which said braking portion juts out below the inferior plane of said ski and an inoperative skiing position, said braking device being associated with a separate control device maintaining the end of said upper leg portion opposite said articulation location in a longitudinal vertical plane of said ski, said control device being sensitive to the presence of a ski boot to assure the passage of said braking member from said operative to said inoperative position when said ski is put on, by a substantially vertical swinging movement of said braking device to a level above the upper plane of said ski combined with pivotal movement of said braking device in a horizontal plane, resulting in a lateral displacement of said braking portion in the direction of the longitudinal axis of said ski, and comprising (a) a movable small rod pivoting substantially in the plane of said ski and bearing at one end against a portion integral with said braking member and at its other end bearing against a fixed pivot point fastened to said ski, keeping the area of said portion in contact with said connecting rod at a constant distance from said pivot point, so that pivoting of said connecting rod when said braking member is pivoted in the horizontal plane and drawn into its inoperative position under the action of the control device brings about a variation in the spacing between said braking member and the plane passing through said longitudinal axis of the ski and the perpendicular to the plane thereof.

2. The device according to claim 1, wherein said braking member is mounted in a base plate attached to the upper plane of the ski, said member being movable in said base plate, on the one hand rotatably about an axis substantially transverse to said longitudinal axis of the ski against the action of a resilient swinging force and, on the other hand, in a generally transverse direction in the plane of the ski against the action of a lateral resilient force, said base plate and said braking member each having a support area, at least one movable connecting rod having rounded ends and being housed for pivoting movement in said base plate between said support area of said base plate for pivoting movement and said braking portion, the latter being formed by said support area of said braking member, at which said connecting rod also pivots.

3. The device according to claim 2, wherein said member comprises a bent and resiliently deformable wire having at least one rectilinear portion extending substantially transversely to the axis of the ski, placed in such a way as to rotate in said base plate and extended, on the one hand, towards the outer surface of the ski by a braking part of said braking member and, on the other, toward said longitudinal axis of the ski, by a leg extending above the ski so as to be subjected to the action of the boot through said control device, said leg being joined to the rectilinear portion by an elbow, said connecting rod having a rounded end portion which is placed in said recess forming the inner portion of said elbow.

4. The device according to claim 3, wherein said connecting rod has, on either side of its rounded end coacting with said base plate, vertical thrust surfaces which cooperate each with a vertical stop forming portion of said base plate and limit the movement of said connecting rod in said base plate.

5. The device according to claim 3 or 4, comprising two braking members, one on either side of the ski, the corresponding upper leg of each member being joined to form a yoke above the upper plane of the ski, two rectilinear portions connecting said yoke to said braking portions and a resilient member mounted in said base plate being harnessed to said yoke so as to urge the same into a raised position with respect to the ski, two movable connecting rods in the plane of the ski being mounted on opposite sides of said yoke between said base plate and said elbow connecting said yoke to one of said rectilinear portions, said connecting rod being displaceable from one position in which they form an acute angle with the longitudinal axis of the ski and a position in which they extend substantially perpendicularly to the longitudinal axis of the ski.

6. The device according to claim 5, wherein the passage of said braking member from said operative to said inoperative position occurs during boot attachment by a substantially vertical swing of said braking member against a vertical resilient pullback force toward said operative position by said resilient member, and by lateral retraction of said braking member against a lateral resilient pullback force, wherein said connecting rod, when said braking member is in its laterally retracted position, is substantially perpendicular to the longitudinal axis of said ski, thereby assuring the neutralization of any vertical component due to the lateral resilient pullback force and capable of being applied to the boot.

7. The device according to claim 6, wherein the lateral retraction of said braking member is produced by the motion of said upper leg portion against the action of a resilient force to which it is subjected, said connecting rod cooperating with said upper leg portion and, in the laterally retracted position of said braking member, applying to said upper leg portion a force parallel to the plane of the ski in a direction converging toward the longitudinal axis of the latter.

* * * * *